US006817130B2

(12) United States Patent
Ivanov

(10) Patent No.: US 6,817,130 B2
(45) Date of Patent: Nov. 16, 2004

(54) SENSOR ARRAY FOR UNAUTHORIZED USER PREVENTION DEVICE

(75) Inventor: Dentcho Ivanov, West Orange, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 0 days.

(21) Appl. No.: 10/462,384

(22) Filed: Jun. 16, 2003

(65) Prior Publication Data

US 2004/0031180 A1 Feb. 19, 2004

Related U.S. Application Data

(60) Provisional application No. 60/389,387, filed on Jun. 17, 2002.

(51) Int. Cl.[7] ..... F41A 17/46

(52) U.S. Cl. ..... 42/70.06; 42/70.01; 42/66; 382/121; 382/124

(58) Field of Search ..... 42/70.01, 70.11, 42/70.08, 70.06, 70.05, 66; 382/121, 124

(56) References Cited

U.S. PATENT DOCUMENTS

| | | | | | |
|---|---|---|---|---|---|
| 3,939,679 | A | | 2/1976 | Barker et al. | |
| 4,003,152 | A | | 1/1977 | Barker et al. | |
| 4,067,132 | A | | 1/1978 | Smith | |
| 4,105,885 | A | | 8/1978 | Orenstein | |
| 4,135,320 | A | | 1/1979 | Smith | |
| 4,141,166 | A | | 2/1979 | Schultz | |
| 4,154,014 | A | | 5/1979 | Smith | |
| 4,457,091 | A | | 7/1984 | Wallerstein | |
| 4,467,545 | A | | 8/1984 | Shaw, Jr. | |
| 4,488,370 | A | | 12/1984 | Lemelson | |
| 4,492,949 | A | * | 1/1985 | Peterson et al. | 338/114 |
| 4,526,043 | A | * | 7/1985 | Boie et al. | 73/862.046 |
| 4,563,827 | A | | 1/1986 | Heltzel | |
| 4,682,435 | A | | 7/1987 | Heltzel | |
| 4,970,819 | A | | 11/1990 | Mayhak | |
| 5,316,479 | A | | 5/1994 | Wong et al. | |
| 5,603,179 | A | | 2/1997 | Adams | |
| 5,636,464 | A | * | 6/1997 | Ciluffo | 42/70.11 |
| 5,915,936 | A | * | 6/1999 | Brentzel | 42/70.11 |
| 6,073,497 | A | * | 6/2000 | Jiang et al. | 73/862.68 |
| 6,185,852 | B1 | | 2/2001 | Whalen et al. | |
| 6,360,468 | B1 | | 3/2002 | Constant et al. | |
| 2002/0170220 | A1 | * | 11/2002 | Recce | 42/70.08 |

* cited by examiner

*Primary Examiner*—Stephen M. Johnson
(74) *Attorney, Agent, or Firm*—Klauber & Jackson

(57) ABSTRACT

Improvements in the sensor array are disclosed for an array used in a module for preventing unauthorized use of a firearm or other device. The module to which the invention is applicable of the type including a plurality of pressure sensors for sensing a user's handgrip on the device; comparator means for comparing a pressure signature profile compiled from an output from said pressure sensors with at least one pressure signature profile in storage; and means for preventing operation of the device when the compared profiles do not match. The improved sensor array comprises a first set of spaced electrically conductive lines formed on the gripping surface; a thin layer of (preferably) piezoresistive material overlying the first set of conductive lines; and a second set of spaced electrically conductive lines formed over the piezoresistive layer. The lines of the second set are orthogonal to the lines of the first set, to establish a grid-like pattern of conductive lines sandwiching the piezoresistive layer. The projected intersections between the lines of the first and second sets (i.e., the grid crossing points) thereby define with the intervening portion of the piezoresistive layer, an array of sensors which are responsive to pressure applied against the gripping surface by a user of the device. Such pressure changes the electrical conductivity in the path including the intersecting lines and intervening piezoresistive material. Signal outputs from the electrical paths including the array of sensors serve to define the pressure signal profile.

12 Claims, 4 Drawing Sheets

PRIOR ART

SENSOR ARRAY FOR UNAUTHORIZED USER PREVENTION DEVICE

This application claims priority from provisional application No. 60/389,387, filed on Jun. 17, 2002.

BACKGROUND OF THE INVENTION

1. Field of the Invention

This invention relates generally to unauthorized user prevention devices, and more specifically relates to a sensor array for use in such devices. While applicable to many environments, the invention is especially applicable to an identification device and method to prevent the discharge of a firearm by anyone other than an owner and/or registered user.

2. Description of the Related Art

All too often there are tragic news reports of people who are gravely injured or killed by gunshots fired by a person who is not the owner or an authorized user of the firearm. Regardless of the specific cause, it is evident that many of these incidents could be avoided if the firearm were only fireable by the owner or other authorized user of the gun.

A number of prior art patents have been directed to technology for solving this vexing problem. U.S. Pat. No. 4,970,819 to Mayhak, for example, discloses a system for sensing the grip pattern of the hand of a potential user of a firearm and permitting the firing thereof if it senses a particular grip pattern of an authorized user which it has been programmed to recognize. The system includes grip pattern sensing means on the handgrip of the firearm, a simulated neural network memory capable of being "trained" to recognize a particular grip pattern and a microprocessor for accessing the neural network to inquire whether it recognizes the grip pattern being sensed by the sensing means. The microprocessor also controls means for permitting and preventing actuation of the firing mechanism of the firearm to allow the firearm to be discharged only when the grip pattern sensed by the sensing means is that of the authorized user which the simulated neural network memory has been programmed to recognize.

U.S. Pat. No. 5,603,179 discloses a safety mechanism for a firearm consisting of a specialized scanning mechanism built into the firearm's trigger. The scanner is programmed to read the unique fingerprints of a given individual. The device is also capable of holding the programmed print information for more than one person, so that multiple people would he able to use the firearm. However, usage is limited to only those persons whose handprints have been prestored in the scanner. The scanner mechanism is connected to the firearm's safety lock. The safety is prevented from being released without proper authorization from the scanner. When a person grips the weapon and places his finger on the trigger, the pressure of the finger on the trigger activates the scanner, and the scanner reads the fingerprint to determine if the scanned fingerprint matches one of the pre-stored fingerprint images. If the individual is an authorized user, the scanner transmits a signal to the safety, releasing this device and activating the firearm for use.

U.S. Pat. No. 5,316,479 to Wong discloses a firearm training system, which allows the measurement and display as a function of time of the hand grip force pattern applied to the grip of a firearm by a weapon hand of a shooter. This permits the detection of variations in the individual handgrip forces in the pattern during firing of the weapon. This firearm training system preferably also provides for the detection and display as a function of time of the position of the firearm trigger. The system includes separate force transducers for the side and front-to-back grip forces applied to the side surfaces and one of the front and back surfaces of the grip respectively as well as a trigger position sensor. A relative value of the hand grip forces detected by the transducers and a relative trigger position detected by the sensor are graphically displayed by the system as a function of time.

In U.S. Pat. No. 6,563,940, assigned to the assignee of the present invention, a further weapon discharge protection system is disclosed that prohibits a firearm, such as a handgun, from being fired by anyone other than its owner or other authorized person. The present invention can be considered as an improvement on the invention of U.S. Pat. No. 6,563,940 patent, and the entire disclosure of such patent is hereby incorporated by reference. In one embodiment of this prior patent, pressure sensors are arranged within the handgrip of the firearm. When one attempts to fire the firearm, he or she exerts a unique pressure signature profile on the handgrip. That is, each person exerts a pressure signature profile that is comprised of (1) the position of the hand on the gun handle; (2) pressure as a function of position on the gun handle; and (3) pressure as a function of time. Pressure signature profiles are sufficiently distinctive as a means for differentiating the owner or other authorized person, whose pressure signature profile is stored in memory, from the remainder of the population-at-large. This signature profile is most differentiating during the half of a second just prior to the trigger pull, as the user prepares to fire the weapon. Initial data show that no more than 1% of the population-at-large possess a given pressure profile. In other words, there is a very low probability that a person who is not the owner or authorized user of a gun would be permitted to fire the gun because he or she matched the stored pressure signature profile.

In one embodiment of the U.S. Pat. No. 6,563,940 patent, quartz crystals, arranged along the surface of the handle, are used as the pressure sensors. When biased these crystals, which are used in timepieces, oscillate at a fixed frequency, and pressure applied to the crystals result in repeatable, precise changes in this oscillation frequency. The electrical signals from the quartz crystals, which correspond to the pressure signature profile, or other sensor material, is inputted to a processing unit, such as a microprocessor. The signal could be the electrical signal generated by the pressure signature profile of the lawful owner or user, inputted to the processing unit for the first time. In this case, by entering a sequence of commands, the signal will be stored within the processing unit as the pressure signature profile of the owner or authorized user. On the other hand, the signal generated by the pressure signature profile could be that of a person who is attempting to fire the firearm, in which case the electrical signal outputted from the crystals to the processing unit is compared to the signal stored as pressure signature profile of the owner or authorized user. If the signal matches the signal stored as the pressure signal profile, then the processing unit activates a mechanism that allows the owner or authorized user to fire the firearm. If the signal outputted from the crystals does not match the signal stored on the pressure signal profile, then the processing unit does not activate the mechanism, so that the firearm cannot be fired.

FIG. 1 herein is taken from the U.S. Pat. No. 6,563,940 patent and is a prior art depiction of a firearm 100, which in this particular example is a handgun having a revolver design. The firearm 100 is provided with a handgrip 120 and is fired when firing mechanism 130 is actuated. The firing mechanism 130 includes trigger 140, which is pivotally mounted in the frame of the gun at 150. Movement of the trigger 140 will cause a hammer 160 to be cocked and released, thus firing a bullet (not shown) stored in the cylinder 170. The firearm 100 is provided with a safety, which is moved in and out of position to prevent and permit the actuation of the firing mechanism 130. The safety is a sliding latch member 180 adapted to engage a portion 190 on trigger 140, which extends under the latch member 180. Latch member 180 is biased by a spring 185 to a position in which it is it is adjacent to portion 190, thereby preventing trigger 140 from being pulled, in which case it pivots around pivot 150 into the fired position. In effect, latch member 180 prevents actuation of the firing mechanism. This handgun is further provided with a solenoid 195 into which an end of latch member 180 is placed. When energized, solenoid 195 retracts latch member 180, overcoming biasing force of spring 185, which removes the latch member 180 from the path of portion 190. With latch member 180 out of the path of portion 190, the trigger can be pulled, actuating the firing mechanism to discharge the firearm. The retraction of the solenoid, or any type of interlock system, is dependent upon recognition of the users as being authorized to use the weapon.

FIG. 2 is a further prior art showing, being FIG. 2 in the same U.S. Pat. No. 6,563,940 patent. The Figure is a schematic block diagram illustrating how the unauthorized user device of the patent can operate. Sensor array 125, which is arranged in the handle of the weapon and may also be arranged in the trigger, or can be part of a special retrofit grip for weapons made prior to the patented invention, provides feedback information regarding the position, pressure, and duration of a person gripping the handle of the weapon. The term "handgrip" is defined as the grip applied to the handle of a device (presumably but not necessarily limited to a weapon) that may also include the pressure asserted on the trigger as well as the pressure asserted on the handle of the weapon. The output from the sensors is provided to comparator 210, which compares these values with values previously stored in storage member 215.

When the comparator 210 finds a match (according to a predetermined variation either built into the device or chosen by user according to a sensitivity switch (not shown)) of the output with a value in storage, the comparator indicates this match to the control unit 220. The indication that there is a match could be, for example, a logic 1 or a logic 0 that is received by the control unit. In turn, the control unit will signal release interlock 230 so that the weapon can be fired. In the case of the example illustrated in FIG. 1, the control unit/cpu 220 would energize the solenoid 195 and retract the latch member 180. It is possible that the control unit (which may or may not be separate from the cpu) could be programmed to have a limited sequence in which the weapon could be used, and once that time has passed, the control unit would again lock the interlock 230 and prevent the firing of the weapon.

The control unit/cpu 220 processes the electrical signals to develop a pressure signal profile including: (1) hand position of the user's handgrip on the particular device as indicated by a change in pressure on the sensor array/pressure sensors; and (2) pressure as a function of position on the gun handle; and (3) pressure as a function of time.

With regard to the three items disclosed above to develop a pressure signal profile, items 1 and 2 provide information regarding the area over which pressure is exerted by a given person, i.e.—the outline of the hand, the outline of the fingers (item 1) pressure on the handgrip, as manifested by the position of the hand on the handgrip, and any variances in the pressure applied by over the area (item 2). Item 3 shows pressure as a function of time, which is also critical because the duration that each person applies pressure by squeezing the grip varies greatly. The pressure signature profile can enable a user to wear thin gloves and still be recognized as the authorized user, which would not be possible in fingerprint recognition systems of the earlier prior art.

Together, the three elements of the profile (items 1–3) in said U.S. Pat. No. 6,563,940 patent provide a unique pressure signal profile that no more than 1% of the population-at-large would possess. The sensors, including the piezoelectrics described above, produce a continuous analog output signal that varies in repeatable manner with applied load, and has a unique output for each level of applied pressure. The "pressure signature profile" is a composite signal that includes voltage changes, oscillation frequency changes, and frequency composition changes. The identification of an individual is performed using a statistical classifier that includes a set of computed weights and thresholds which separate the "pressure signature" of an individual from that of the rest of the population.

When a force is applied to the handgrip the sensors output an electrical signal to the control unit. In one embodiment the control unit may be a microprocessor located within the firearm, for example, within the handgrip. The control unit compares it to the signal stored as the pressure profile of the lawful owner or authorized user. The microprocessor simultaneously reads the signals from all of the sensors and continuously searches for the dynamic pattern corresponding to the valid "pressure signature." Components of the sensor signal are multiplied by the computed weights and stored thresholds are applied. If the signal exceeds these computed thresholds then the firearm is allowed to fire during a predetermined time interval (e.g. 500 milliseconds).

Once the pressure signal profile has been identified as that of an authorized user, the decision as to how long such an authorized user would be allowed to use the device could be based on a number of factors that could be programmable according to an individual's preference. For example, police officers sometimes pull weapons at armed perpetrators and order them to freeze. Sometimes there can be a "standoff" where the police have a weapon pointed at a particular perpetrator, who is not putting down his weapon nor has his hands in the air, prior to being handcuffed. If the time permitted to fire the weapon is too short, the gun could reset and the police officers would be unable to defend against a subsequent attack by the perpetrator (or possible accomplices) until the gun was gripped again, or reactivated by pressing an "on" switch, etc. If the time is set for too long, the weapon could be wrestled from the authorized user and fired by an unauthorized user.

A Motion sensor could also be included both to begin the process by activating the device, and after a certain period of time without any motion, to end it. Since a firearm is typically pointed down while in a holster, a predetermined tilt angle could be programmed in to activate the detection, or the mere squeezing of the grip while induce a voltage in the piezoelectric type sensors that could turn on the device.

Suitable sensors in this prior art disclosure include a sensing element into which a piezoelectric element has been embedded. Suitable piezoelectric elements include quartz crystals. Other suitable piezoelectric materials including lead titinate and lead zirconate, could be used in either a crystalline or film form. The pressure signal could also be measured using strain gauges or micro-machined pressure sensors (MEMS).

Systems employing piezoelectric materials, such as the crystals described above, produce an electrical output when they experience a change in load, i.e., pressure. Making use of this phenomenon, an embodiment of the U.S. Pat. No. 6,536,940 patent includes the transmission of electrical signal from the sensors, in response to pressure applied when a person grips the handle of the firearm, to a control unit located within the firearm. A purpose-built electronic circuit is used to convert the voltage and frequency changes measured from the sensors into a digital signal read by the processor. An electrostrictive system could also be employed.

This "pressure signature" signal is programmed into the handgun by an independent station that is held by the authority that registers handguns. Such authority, for example, could be a state or local entity, or even an authorized third party. The owner of the handgun fires the gun ten to twenty times, and the pressure patterns unique to that individual are computed by a purposely-built data acquisition and analysis system. It is protected from abuse by one of several possible mechanisms, including encryption of the stored signal and tamper detection systems that can completely disable the firearm.

Grip pattern signals from sensing means 125 are fed from the firearm 100 over a line 129 to the host computer. A jack 131 in the butt of firearm handgrip 120 permits line 129 to be connected to the firearm. The pressure sensors and central processing unit/control unit within the handgun are powered by a power source, typically a battery system (not shown) that could be located in the ammunition clip of the handgun. This arrangement allows the battery to be recharged in empty ammunition clips that are not in use.

The invention of the U.S. Pat. No. 6,563,940 patent is also applicable to devices other than fire arms. A Steering wheel of a vehicle may e.g., either have sensors built in, or a steering wheel cover could be attached over the steering wheel. The unauthorized user prevention device could be located anywhere in the automobile, for example, in the steering column, under the dashboard, under the hood, in the trunk, etc. The device could be powered by the vehicle's battery. Similar to the pressure profile used for preventing unauthorized users from activating a weapon, a pressure profile from squeezing the steering wheel based on the three items (position, pressure and time) can be stored. There can be an ignition cutoff switch, fuel cutoff switch, etc. that would only be deactivated when the user squeezing the steering wheel matches a profile in storage, thus being an authorized user. The user could squeeze the wheel with a "secret handshake" (which can also be used with a weapon) that could be anywhere from just one finger to all ten. The number of possibilities, based on in part on the number of sensors and the number of combinations of fingers squeezing different areas at different pressure for different time periods would result in the chance of an unauthorized user gaining access as extremely remote being one in thousands or tens of thousands, as opposed to one in one hundred. A control unit or cpu would compare the profiles and deactivate the interlock.

The unauthorized user prevention device of U.S. Pat. No. 6,563,940 could also work on a "keyless" door handle. A series of sensors could be embedded in the door handle. The user gripping the door would create a pressure profile based on position, pressure and time. This profile could be compared with stored pressure profiles that would release the lock if the person gripping the door handle matches one of the profiles in storage. The cpu or control unit could be remotely located, and the sensor feedback could be transmitted to the control unit by wire, fiber optics, or RF.

SUMMARY OF THE INVENTION

The biometric pattern recognition technology discussed in the foregoing prior art uses electrical signals provided by miniature pressure sensors typically located by embedding in the gun handle. The authentication algorithm performance depends on the density, size, shape, and location of pressure sensors on the handle of the handgun. Fabrication of pressure sensor arrays embedded in the gun's grip using discrete piezoelectric elements (quartz, PZT ceramic, or lithium niobate) has proven inefficient and costly because of the complex ergonomic shape of the gun grip. The discrete pressure sensors are solid plates. The gun grip has to be mechanically machined in order to install the pressure sensors and ensure good mechanical contact with the palm of the gun user. The fabrication of such a gun grip is highly inefficient, expensive, and unreliable. The sensors are vulnerable to damages caused by extensive pressure or exposure to moisture. Fabrication difficulties limit the number of sensors that can be installed in the grip (typically a maximum of around 10). Low sensor density in the pressure array decreases the resolution, which depends on the number of "pressure pixels". Other serious limitation of the embedded piezoelectric sensors include the strong dependence of the piezoelectric effect on temperature. Temperature variations of ±25° C. can cause significant changes of the frequency of the quartz resonators. Lithium niobate is even more sensitive than quartz to temperature changes. PZT ceramics depolarizes irreversibly at 90° C.

Now in accordance with the present invention, improvements in the sensor array are provided for use in a module for preventing unauthorized use of a firearm or other device. The module to which the invention is applicable can be of the type in the U.S. Pat. No. 6,563,940 patent, i.e., including a plurality of pressure sensors for sensing a user's handgrip on the gripping surface of the device; comparator means for comparing a pressure signature profile compiled from an output from said pressure sensors with at least one pressure signature profile in storage; and means for preventing operation of the device when the compared profiles do not match. The improved sensor array comprises a first set of spaced electrically conductive lines formed on the gripping surface; a thin layer of (preferably) piezoresistive material formed overlying the first set of conductive lines; and a second set of spaced electrically conductive lines formed over the piezoresistive layer. The lines of the second set are orthogonal to the lines of the first set, to establish a grid-like pattern of conductive lines sandwiching the piezoresistive layer. The projected intersections between the lines of the first and second sets (i.e., the grid crossing points) thereby define with the intervening portion of the piezoresistive layer, an array of sensors which are responsive to pressure applied against the gripping surface by a user of the device. Such pressure changes the electrical conductivity in the path including the intersecting lines and intervening piezoresistive material. Signal outputs from the electrical paths including the array of sensors serve to define the pressure signal profile.

BRIEF DESCRIPTION OF THE DRAWINGS

The invention is diagrammatically illustrated, by way of example, in the drawings appended hereto, in which.

DESCRIPTION OF PREFERRED EMBODIMENT

In the present invention a simple, low-cost, low-power, thin-film technology is used for the fabrication of a patterned piezoresistive pressure sensor array on a gun grip or other device gripping surface. The thin film technology allows fabrication of pressure sensors arrays that follow exactly the shape of the grip (e.g., a curved surface) and there is no need for mechanical machining of the grip. Using microelectronics patterning techniques thousands of "pressure pixels" can be produced. This enables an increase in the array's resolution to the extent that one can measure not only handgrip dynamic parameters but also fingerprints. This is impossible with prior art pressure arrays with low pixel density. Although the sensor array of the invention can use piezoelectric materials as pressure sensors, the preferred piezoresistive thin film sensor array has a major advantage with respect to a piezoelectric sensor array—it is temperature independent in the range ±250° C. The density, size, shape and location of the discrete pressure sensors in the array are determined using the biometric pattern recognition algorithm for grip detection.

Figure 1:
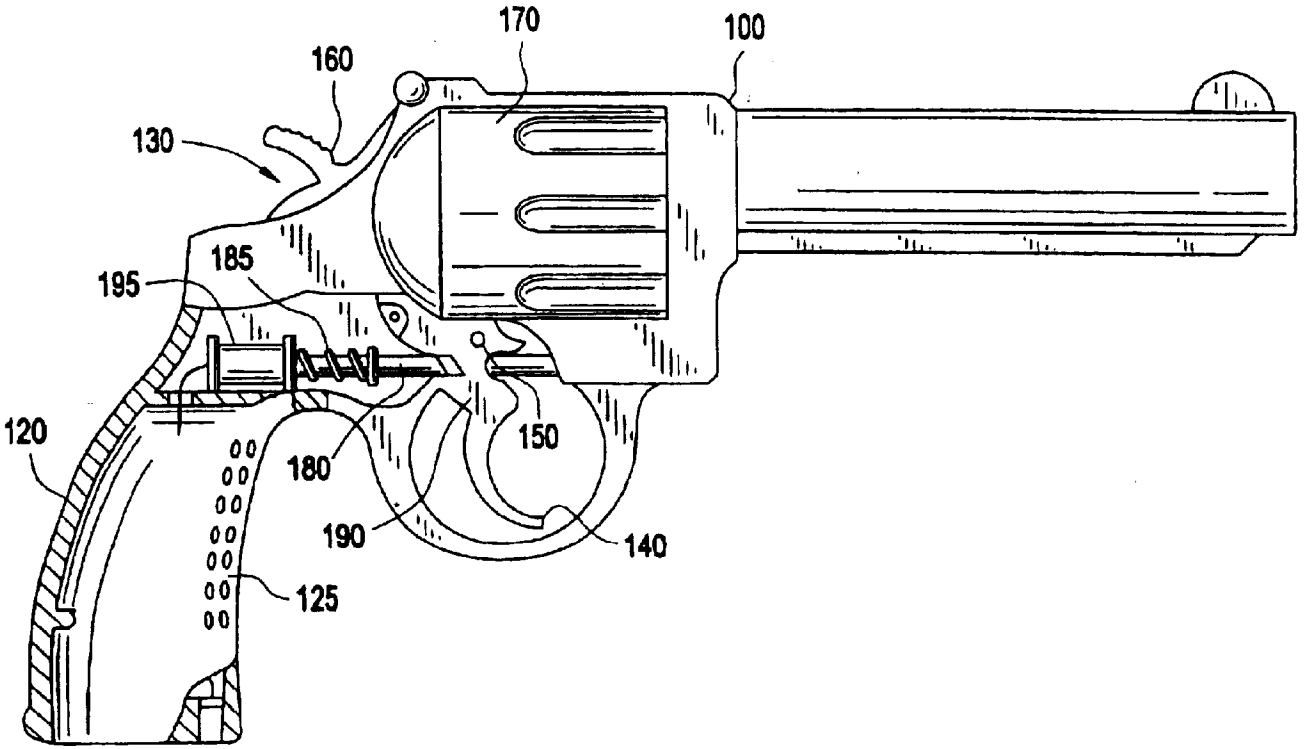
FIG. 1 is prior art, showing in elevation a firearm incorporating the invention of U.S. Pat. No. 6,563,940.
Figure 2:
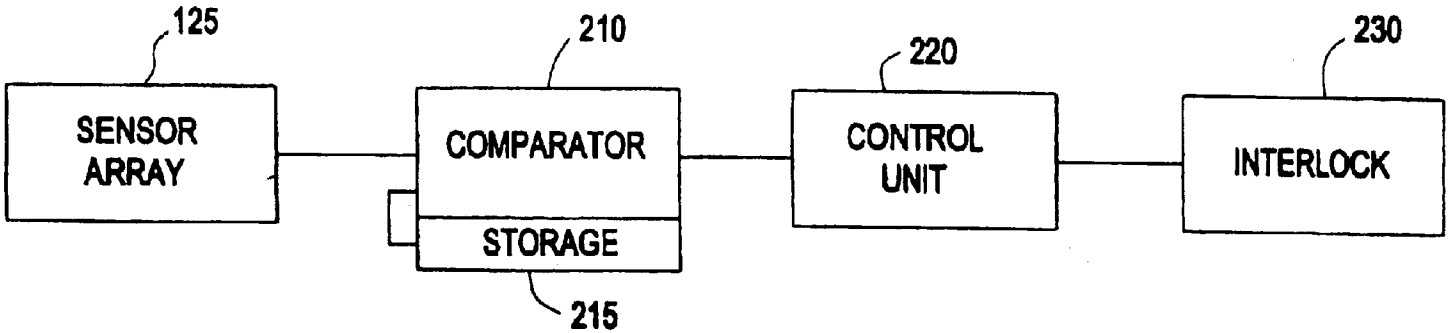
FIG. 2 PRIOR ART
FIG. 2 is a prior art schematic block diagram illustrating the basic operating principles for the invention of U.S. Pat. No. 6,563,940.
Figure 3:
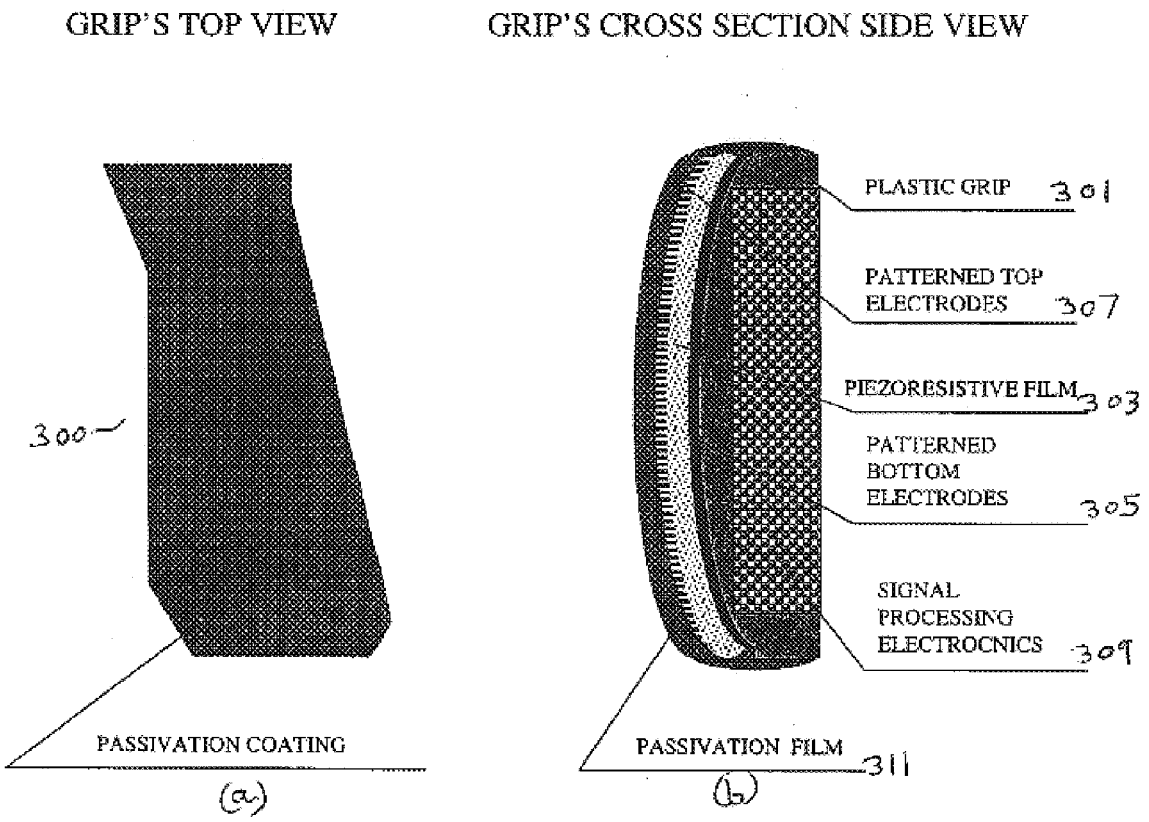
FIGS. 3(*a*) and 3(*b*) are schematic plan and longitudinal cross sections in a handgun grip utilizing a sensor array in accordance with the present invention.
Figure 4:
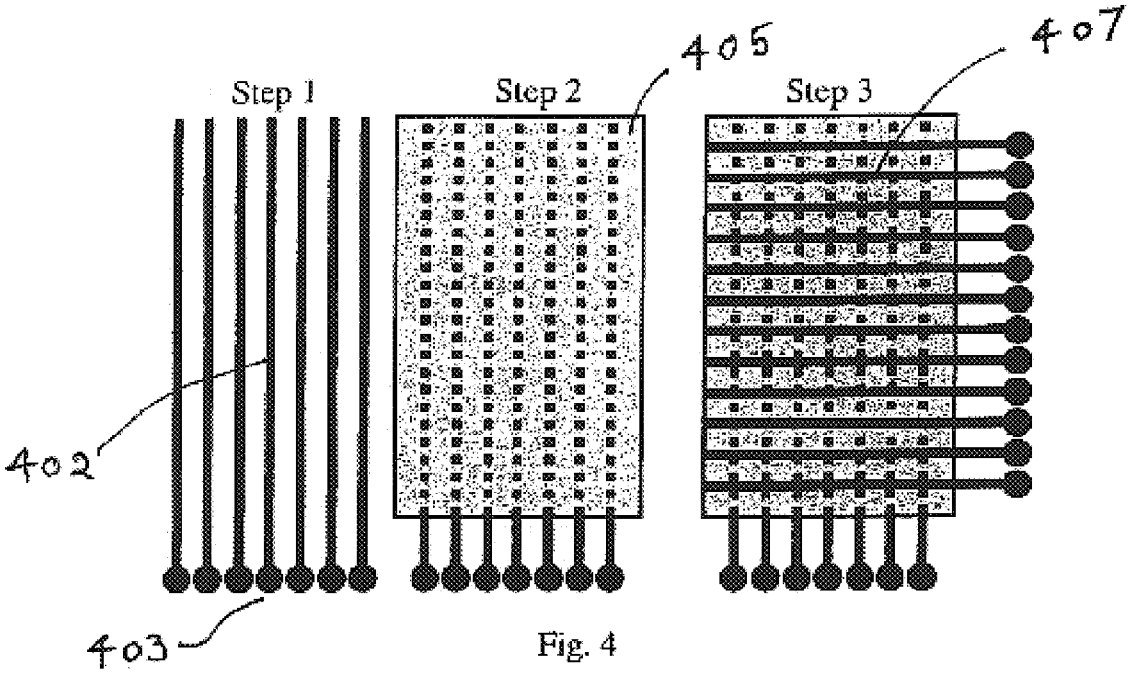
FIG. 4 is a schematic diagram depicting the steps involved in preparing a sensor array in accordance with the present invention.

FIG. 3 may be viewed together with FIG. 4. FIG. 3 schematically shows a plan view and a longitudinal sectional view of a gun grip upon which a sensor array has been formed. FIG. 4 illustrates the basic steps involved in fabrication of the sensor array 401 in which a thin piezoelectric or the preferred piezoresistive thin film 303 is confined between two patterned metal electrodes 305 and 307. The pressure detection in this case uses vertical longitudinal stress components. The plastic or other relatively nonconductive plates 301 of the gun grips 300 are used as supports for the sensor array. After cleaning the plates 301, e.g., in 1-methyl-2-pyrrolidinone solution at 95° C. for better adhesion, a metal thin film 305 is deposited using DC sputtering or e-beam evaporation technique. This metal film (after patterning) is used as a ground electrode of the pressure sensor array. On top of this metal thin film 305 another thin film 303 of a piezoresistive material (e.g., a doped polysilicon) is deposited using chemical vapor deposition (CVD) technique. A second thin metal film 307 is deposited on top of the piezoresistive thin film 303 by sputtering in such a way that the piezoresistive film becomes the middle part of a sandwich structure, i.e., it is present between the two metal thin films 305 and 307, both of which are patterned. The upper metal electrode 307 is the ground electrode. The buried metal film 305 is the measuring electrode. Both electrodes are patterned into sets of approximately parallel conductive lines using photolithography or laser ablation and shaped using wet or dry etching.

The fabrication process steps are seen in FIG. 4, and are as follows:

Step 1

After cleaning, the nonconductive gun grip is coated with a metal thin film to a thickness about 1 micron. Metals such as Cr, Ti, Ni, Cu, Al, Au can be used. For better adhesion a multilayer coating can be deposited. The first film is Cr (which has good adhesion to the plastic surface) with typical thickness of 0.1 micron, followed by a deposit of about 1 micron of the other metal such as Ni. The coating instrumentality used can be reactive magnetron sputtering, e-beam evaporation, or electroplating. The metal film 305 is patterned into special parallel conductive lines 402 as shown in the Figure. The patterning technique can be accomplished by photolithography followed by wet or dry etching, or can be direct laser ablation. In the case of electroplating the seed (bottom most) layer has to be patterned only. The secondary deposition will be made on top of seed layers automatically. The ends 403 of the metal lines 402 are the connections to the electronic circuitry 309 located in the back of the grip.

Step 2

The second step consists in deposition of a piezoresistive film 405 typically using a CVD (Chemical Vapor Deposition) technique. This layer can be doped polysilicon or amorphous silicon. Piezoresistance is defined as the change in electrical resistance of a solid when subject to mechanical stress. As mentioned, the material deposited can also be piezoelectric (i.e., one which produces a charge or potential across it in response to mechanical stress) but the use of piezoeresistance is preferred.

Step 3

Step 3 is a deposition of a second metal film 307 of the thickness of about 1 micron. The film is patterned in the same way as the first one, however, this time the metal lines 407 are orthogonal to the lines 401 of metal film 305. A pressure sensor pixel is formed by the projected intersection of two lines from the different sets, i.e., together with the intervening portion of the piezoresistive film which isolates electrically both metal grids.

Step 4

The last step is to passivate the sandwich structure by a thin film 311 of silicon nitride or silicon carbide. (FIG. 3(*b*)) This step is not shown in the Figure. The role of this film 311 is to protect the structure of the elements. Silicon nitride and silicon carbide are materials harder and stronger than steel with high durability. The passivation layer 311 of silicon nitride or silicon carbide is deposited using chemical vapor deposition to make the sensor array waterproof and shock-resistant.

Figure 5:
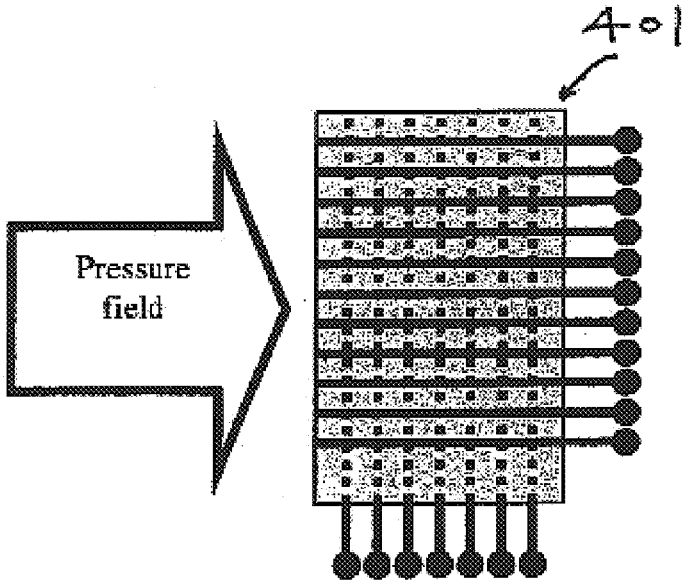
FIG. 5 is a schematic diagram showing how an input pressure pattern is detected by a sensor array in accordance with the present invention.

The sensory effect consists in measuring the resistance of the piezoresistive film at the sensor which is effectively defined at the intersection between the two lines. The intersection point forms a "mechanical pixel" able to detect pressure. When pressure is applied in this point the resistivity of the piezoresistance film changes. FIG. 5 shows the principle of operation of the sensor array. The handshake with the gun grip thus causes a pressure profile related to the specific biometrics characteristics of the hand of the user such as handgrip, size of the palm, topology of the palm, fingerprints, specific skin features, etc. The pressure field distribution is detected by the sensor array, which can be programmed by the monitoring electronics in order to detect pressure fields on smaller or larger areas using various numbers of pixels. The decision-making electronics scans the dynamic range of the sensory array by increasing and decreasing the number of pixels involved in the measurements. In this way various biometrics characteristics of the palm can be measured starting with the size of the hand and finishing with the fingerprints. The pressure sensor array will respond to the pressure filed by providing a matrix of resistance values measured by an integrated bridge circuitry. The handgrip characteristics of the authorized gun user are stored in the chip memory and are compared to the measured characteristics in real time.

One particular advantage of the present invention is that it is applicable to any gun grips, including those with non-planar shapes. The thin-film deposition technology does not impose any restriction on the substrate's shape, in which the pressure sensor array with any number of pixels is embodied. Thus for example, the substrate can have a curved or rounded surface, configurations which are indeed common in gun grips or in gripping surfaces for other devices such as tools.

Furthermore, the grip with the pressure sensor array is fabricated separately from the gun. In this way the gun construction is not altered. The manufacturer can easily connect the module electrically to the gun actuation mechanism enabling/disabling the gun's operation.

The piezoresistive materials preferably used for the fabrication of the pressure sensor array have the advantage over the piezoelectric elements of being temperature insensitive, of enabling simple signal processing, of providing high signal-to-noise ratio, and of enabling the possibility of fabricating large number of "pressure pixels".

Thin-film microelectronics technologies used for the fabrication of the pressure sensor array on the gun grip allow low-cost mass production of the system. The number of pixels has little or no no influence on the manufacturing cost. Large number of "pressure pixels" gives new dimensions of the pattern recognition algorithm technology because of large dynamic and sensitivity range. The large number of "pressure pixels" enables one to measure pressure fields in various size areas from palm size to fingerprints. This cannot be achieved with the discrete embedded piezoelectric elements of the prior art.

Various modifications can be made to the above disclosure that are within the spirit of the invention and the scope of the appended claims. For example, the unauthorized user prevention device has been particularly illustrated for uses on handguns, but clearly can be used with rifles, shotguns, any projectile launching weapon, and even non-projectile type weapons. The device and method can similarly be used to prevent unauthorized access in vehicles, boats, or any apparatus having a hand control that can be squeezed, such as a steering wheel, gearshift knob, joystick, throttle, brake handle etc. In fact, in a vehicle, the sensor could even be located in the dashboard or a door handle, and a user would simply squeeze a portion for access to start the engine.

Accordingly the present invention is to be broadly construed, and limited only by the scope and spirit of the claims now appended hereto.

I claim:

1. In an unauthorized user prevention system for preventing unauthorized users from operating a particular device, said system comprising:

an interlocking means for deactivating the particular device;

a plurality of pressure sensors disposed at a gripping surface of the device for sensing a user's handgrip on the device;

comparator means for comparing a pressure signature profile compiled from an output from said pressure sensors with at least one pressure signature profile in storage;

control unit/cpu means for receiving an output from said comparator means indicating that the signature profile compiled by said comparator means matches said at least one pressure signature profile in storage; and wherein said control unit/cpu means releases said interlocking means upon receipt of a signal from said comparator means that the pressure signature profile of the user's handgrip on the particular device matches said at least one pressure signature profile in storage;

The improvement, wherein said sensors comprise:

two orthogonal sets of conductive lines and an intervening piezoresistive or piezoelectric layer being deposited upon said gripping surface, whereby the electrical path between a line of said first set and a line of said second set passes through the intervening piezoresistive or piezoelectric material where the two orthogonal lines cross to define at the crossing a sensor responsive to pressure applied against the gripping surface overlaying the crossing by changing the electrical conductivity or potential in the path including the two said crossing lines and intervening piezoresistive or piezoelectric material; the multiple crossings of said two orthoganal sets of lines defining an array of said sensors; and the signal outputs from the electrical paths including said sensors serving to define said pressure signature profile for a user of said device.

2. The invention of claim 1, further including a passivation layer overlying the sets of conductive lines and intervening piezoresistive or piezoelectric layer.

3. The invention of claim 2, wherein said passivation layer comprises silicon nitrite or silicon carbide.

4. In a module for preventing unauthorized use of a fire arm or other device, said module including a plurality of pressure sensors for sensing a user's handgrip on the device;

comparator means for comparing a pressure signature profile compiled from an output from said pressure sensors with at least one pressure signature profile in storage; and means for preventing operation of said device where the compared profiles do not match;

The improvement wherein said sensors comprise:

a first set of spaced electrically conductive lines formed on said gripping surface;

a thin layer of piezoresistive material formed in overlying relation to said first set of lines;

a second set of spaced conductive lines formed over said piezoresistive layer, the lines of said second set being orthogonal to the lines of said first set;

the projected intersections between the lines of said first and second sets defining with the intervening portion of said piezoresistive layer, sensors which are responsive to pressure applied against the gripping surface by a user of the device by said pressure changing the electrical conductivity in the path including the intersecting lines and intervening piezoresistive material; the signal outputs from the electrical paths including said sensors serving to define said pressure signal profile.

5. The invention of claim 4, further including a passivation layer overlying the sets of conductive lines and intervening piezoresistive layer.

6. The invention of claim 5, wherein said passivation layer comprises silicon nitride or silicon carbide.

7. The invention of claim 4, wherein said device is a firearm.

8. The invention of claim 4, wherein the gripping surface is curved.

9. In an unauthorized user prevention system for preventing unauthorized users from operating a particular device, said system comprising:

an interlocking means for deactivating the particular device;

a plurality of pressure sensors disposed at a gripping surface of the device for sensing a user's handgrip on the device;

comparator means for comparing a pressure signature profile compiled from an output from said pressure sensors with at least one pressure signature profile in storage;

control unit/cpu means for receiving an output from said comparator means indicating that the signature profile compiled by said comparator means matches said at least one pressure signature profile in storage; and wherein said control unit/cpu means releases said interlocking means upon receipt of a signal from said comparator means that the pressure signature profile of the user's handgrip on the particular device matches said at least one pressure signature profile in storage;

an improved method for forming the said pressure sensors, comprising:

depositing two orthogonal sets of conductive lines and an intervening piezoresistive or piezoelectric layer being upon said gripping surface, whereby the electrical path between a line of said first set and a line of said second set passes through the intervening piezoresistive or piezoelectric material where the two orthogonal lines cross to define at the crossing a sensor responsive to pressure applied against the gripping surface overlaying the crossing by changing the electrical conductivity or potential in the path including the two said crossing lines and intervening piezoresistive or piezoelectric material; the multiple crossings of said two orthoganal sets of lines defining an array of said sensors; and the signal outputs from the electrical paths including said sensors serving to define said pressure signature profile for a user of said device.

10. The method of claim 9, wherein the deposited intervening layer is piezoresistive.

11. The method of claim 9, wherein the outermost set of conductive lines is overcoated with a passivating layer.

12. The method of claim 11, wherein the passivating layer is silicon carbide or silicon nitride.

* * * * *